US007739107B2

(12) United States Patent
Kim

(10) Patent No.: US 7,739,107 B2
(45) Date of Patent: Jun. 15, 2010

(54) VOICE SIGNAL DETECTION SYSTEM AND METHOD

(75) Inventor: Hyun-Soo Kim, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 807 days.

(21) Appl. No.: 11/542,866

(22) Filed: Oct. 4, 2006

(65) Prior Publication Data

US 2007/0100609 A1 May 3, 2007

(30) Foreign Application Priority Data

Oct. 28, 2005 (KR) ..... 10-2005-0102583

(51) Int. Cl.
*G10L 21/00* (2006.01)

(52) U.S. Cl. ..... 704/215; 704/233; 370/290

(58) Field of Classification Search ..... 704/215, 704/233; 370/290
See application file for complete search history.

(56) References Cited

U.S. PATENT DOCUMENTS

| | | | | |
|---|---|---|---|---|
| 4,514,703 | A * | 4/1985 | Maher et al. | 330/279 |
| 4,975,657 | A | 12/1990 | Eastmond | |
| 5,563,925 | A | 10/1996 | Hernandez | |
| 6,314,395 | B1 * | 11/2001 | Chen | 704/233 |
| 6,480,823 | B1 | 11/2002 | Zhao et al. | |
| 2003/0206624 | A1 * | 11/2003 | Domer et al. | 379/406.01 |

FOREIGN PATENT DOCUMENTS

| | | |
|---|---|---|
| CN | 1242553 | 1/2000 |
| EP | 0 123 349 | 6/1987 |
| GB | 1 343 869 | 5/1972 |
| JP | 59-104700 | 6/1984 |
| JP | 02-244200 | 9/1990 |
| JP | 07-013585 | 1/1995 |
| JP | 10-301594 | 11/1998 |
| JP | 2000-066691 | 3/2000 |
| JP | 2001-067092 | 3/2001 |
| JP | 2002-531882 | 9/2002 |
| JP | 2003-330491 | 11/2003 |
| JP | 2007-072005 | 3/2007 |
| KR | 100195009 | 2/1999 |
| WO | WO 00/33294 | 6/2000 |
| WO | WO 01/39175 | 5/2001 |

OTHER PUBLICATIONS

E. Fariello, "A Novel Digital Speech Detector for Improving Effective Satellite Capacity", IEEE Transactions on Communications, Feb. 1972.

* cited by examiner

*Primary Examiner*—Daniel D Abebe
(74) *Attorney, Agent, or Firm*—The Farrell Law Firm, LLP

(57) ABSTRACT

Provided is a voice signal detection system and method, which extracts peaks from an input signal, compares a voltage level of each of the extracted peaks to a pre-set threshold voltage level, converts the comparison result to a binary sequence, determines the length of a test window to examine the converted binary sequence, detects micro events in a test window length unit, links the detected micro events, and determines a starting and ending point of a voice signal by detecting a starting and ending point of the linked micro events. Accordingly, by extracting and analyzing peak characteristic information of a time axis, voice can be detected with minimal calculation and noise interference.

16 Claims, 7 Drawing Sheets

VOICE SIGNAL DETECTION SYSTEM AND METHOD

PRIORITY

This application claims priority under 35 U.S.C. §119 to an application entitled "Voice Signal Detection System and Method" filed in the Korean Intellectual Property Office on Oct. 28, 2005 and assigned Serial No. 2005-102583, the contents of which are incorporated herein by reference.

BACKGROUND OF THE INVENTION

1. Field of the Invention

The present invention relates generally to a voice signal detection system and method, and in particular, to a voice signal detection system and method for detecting a voice signal using peak information in a time axis.

2. Description of the Related Art

There has been a recent increase in the development of systems using voice signals, to perform processes such as coding, recognition and strengthening, based on the voice signal. Accordingly, methods of accurately detecting the voice signal have been increasingly researched.

Two conventional methods of detecting a voice signal are a method using energy of an input signal and a method using a zero crossing rate. The method using energy is a method of measuring energy of an input signal and detecting a portion in which measured energy is high as a voice signal if the measured energy value is high. The method using a zero crossing rate is a method of measuring a zero crossing rate of an input signal and detecting a portion thereof which is high as a voice signal. Recently, to increase accuracy of voice signal detection, a method of combining the two methods has also been being frequently used.

The two above-described methods have low accuracy in a state where noise is included in an input signal. For example, since the method of detecting a portion in which a measured energy value is high as a voice signal does not consider energy due to noise, if the energy due to noise is high, a noise signal may be recognized as a voice signal, and vice versa.

In addition, since the method of detecting a portion in which a zero crossing rate is high as a voice signal cannot determine whether zero crossing occurs by a noise signal or a voice signal, if the zero crossing rate is high due to the noise signal, the noise signal may be recognized as the voice signal, and vice versa.

In the above methods, a noise signal recognized as a voice signal is called an additive error, and a voice signal recognized as a noise signal is called as a subtractive error. For the additive error, a noise signal can be cancelled through an additional process. However, for the subtractive error, since a voice signal has been already recognized as a noise signal and cancelled, the voice signal cannot be recovered in most cases. Thus, a voice detection technique for fundamentally preventing the subtractive error is required.

In addition, most of the conventional voice signal detection methods detect a voice signal in a frame unit. In this case, even if an error occurs in a unit smaller than the frame unit, the error is recognized as an error of a frame unit. In addition, since the above-described conventional voice signal detection methods detect a voice signal using a fixed method, if a determined algorithm fails, an error due to the failure is transferred to a process of a subsequent stage, thereby causing multiple errors.

SUMMARY OF THE INVENTION

An object of the present invention is to substantially solve at least the above problems and/or disadvantages and to provide at least the advantages below. Accordingly, an object of the present invention is to provide a voice signal detection system for correctly detecting a voice signal in a state where noise exists and a voice signal detection method using peak information of a time axis in the voice signal detection system.

Another object of the present invention is to provide a voice signal detection system for preventing a subtractive error by which a voice signal is recognized as a noise signal, and a voice signal detection method using peak information of a time axis in the voice signal detection system.

A further object of the present invention is to provide a voice signal detection system for receiving fewer errors by detecting a voice signal in a sample unit that is not a frame unit, and a voice signal detection method using peak information of a time axis in the voice signal detection system.

A further object of the present invention is to provide a voice signal detection system for preventing an accumulation of errors so that an error generated in previous voice signal detection does not affect current voice signal detection, and a voice signal detection method using peak information of a time axis in the voice signal detection system.

According to the present invention, there is provided a voice signal detection system including a peak extractor for extracting peaks from an input signal, a peak detector for comparing a voltage level of each of the extracted peaks to a threshold voltage level and converting the comparison result to a binary sequence, a micro event detector for determining the length of a test window to examine the converted binary sequence and detecting micro events in a test window length unit, a micro event link module for linking the detected micro events, and a voice signal starting and ending point detector for determining a starting point and an ending point of a voice signal by detecting a starting and ending point of the linked micro events.

According to the present invention, there is provided a voice signal detection method including extracting peaks from an input signal, comparing a voltage level of each of the extracted peaks to a threshold voltage level and converting the comparison result to a binary sequence, determining the length of a test window to examine the converted binary sequence and detecting micro events in a test window length unit, linking the detected micro events, and determining a starting point and an ending point of a voice signal by detecting a starting and ending point of the linked micro events.

BRIEF DESCRIPTION OF THE DRAWINGS

The above and other objects, features and advantages of the present invention will become more apparent from the following detailed description when taken in conjunction with the accompanying drawing in which.

DETAILED DESCRIPTION OF THE PREFERRED EMBODIMENT

Figure 1:
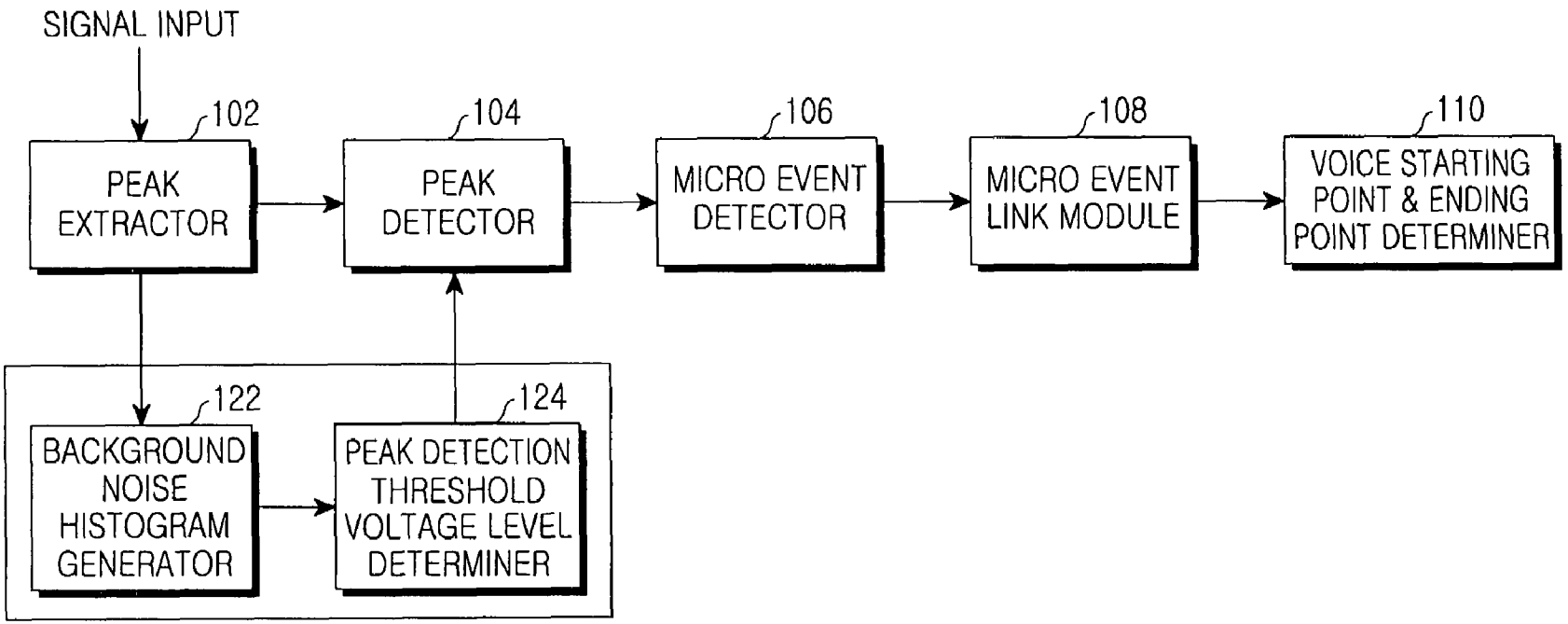
FIG. 1 is a block diagram of a voice signal detection system according to the present invention.

Preferred embodiments of the present invention will be described herein below with reference to the accompanying drawings. In the drawings, the same or similar elements are denoted by the same reference numerals even though they are depicted in different drawings. In the following description, well-known functions or constructions are not described in detail for the sake of clarity and conciseness.

FIG. 1 is a block diagram of a voice signal detection system according to the present invention. Referring to FIG. 1, the voice signal detection system includes a peak extractor 102, a background noise histogram generator 122, a peak detection threshold voltage level determiner 124, a peak detector 104, a micro event detector 106, a micro event link module 108 and a voice starting point & ending point determiner 110.

The peak extractor 102 determines a window length T for extracting peaks of an input signal and extracts the peaks from the input signal. In the current embodiment, when only background noise exists in an input signal (null hypothesis), the input signal is indicated by $H_0$, and when background noise and voice coexist in an input signal (alternative hypothesis), the input signal is indicated by $H_1$.

The background noise histogram generator 122 generates a histogram using the peaks extracted from the input signal in which only background noise exists, and voltage levels of the extracted peaks. That is, the background noise histogram generator 122 generates a histogram representing estimation values of a probability density function (PDF) of the peak amplitudes using the peaks extracted from the input signal in which only background noise exists, and voltage levels of the extracted peaks.

The peak detection threshold voltage level determiner 124 determines a threshold voltage level L corresponding to a pre-set peak count ratio r using the histogram of the voltage levels of the peaks extracted from the input signal in which only background noise exists. For example, if it is assumed that the number of peaks extracted from the input signal in which only background noise exists is 100, the peak detection threshold voltage level determiner 124 determines the threshold voltage level L so that the number of peaks having a voltage level greater than the threshold voltage level L is 5 when r is 0.05 and determines the threshold voltage level L so that the number of peaks having a voltage level greater than the threshold voltage level L is 2 when r is 0.02.

The threshold voltage level L can be determined by a basis that an existence probability of peaks in a portion greater than the threshold voltage level L can be calculated using the sum of binominal coefficients as shown in Equation 1.

$$P(r, N, W) = \sum_{i=N}^{W} \binom{W}{i} r^i (1-r)^{W-i} \tag{1}$$

In Equation 1, W denotes the length of a test window shifting by one peak, r denotes a ratio of the number of peaks having a voltage level greater than the threshold voltage level L to the number of extracted peaks, and P denotes a probability that a peak sequence having the length W contains more than N peaks having a voltage level greater than the threshold voltage level L.

If the threshold voltage level L is determined, the peak detector 104 compares voltage levels of peaks extracted from the input signal in which background noise and voice coexist to the determined threshold voltage level L and detects peaks having a voltage level greater than the threshold voltage level L. The peak detector 104 converts a peak sequence extracted from the input signal in which background noise and voice coexist to a binary sequence according to whether voltage levels of the peak sequence are greater than the threshold voltage level L. That is, if a voltage level of the peak sequence extracted from the input signal in which background noise and voice coexist is greater than the threshold voltage level L, the voltage level is converted to '1', and if a voltage level of the peak sequence extracted from the input signal in which background noise and voice coexist is less than the threshold voltage level L, the voltage level is converted to '0'. For example, the peak sequence is converted to a binary sequence '1100011110001111', which is input to the micro event detector 106.

The micro event detector 106 determines the test window length W to examine the input binary sequence and obtains the number of peaks having the value '1' in each test window by examining the input binary sequence in a test window length unit. When the number of peaks having the value '1' out of total peaks in each test window reaches a pre-set number, the micro event detector 106 detects this result as a micro event.

For example, in the current embodiment, it can be determined that if 3 peaks having the value '1' exist in a test window when the test window length W is set to 4-peak length, the micro event detector 106 detects this result as a micro event. In addition, it can be determined that if 3 peaks having the value '1' exist in a test window when the test window length W is set to 5-peak length, the micro event detector 106 detects this result as a micro event. The micro event can be a minimum unit of peaks, which can be detected as voice, and micro events detected as a unit of voice detection are input to the micro event link module 108.

The micro event link module 108 links micro events, which satisfy a temporal relationship threshold to each other, among the input micro events. Herein, chains of the linked micro events correspond to parts of articulated voice.

When micro events are linked, if a gap exists between the linked micro events, a difference between the linked micro events and an original voice signal occurs, thereby creating uncertainty in detection of a starting point and an ending point of the original voice signal. To solve this problem, link criteria for linking the micro events are required. The link criteria can be determined by referring to the research of voice attributes and temporal consistency from the following reference: 'B. Reaves, "Comments on: An Improved Endpoint Detector for Isolated Word Recognition", IEEE Transactions on Signal Processing, Vol. 39 No. 2, February 1991.' (hereinafter Reaves)

In Reaves, a feature that two separate voice signals can be linked is described, and in the current embodiment, voice signals can preferably be linked under a link criterion of 40 ms. That is, if a gap between two micro events is within 40 ms, the two micro events are linked (the two micro events can actually be linked in a range of 25-150 ms). Herein, the linking threshold can be changed according to L or r. As described above, the micro events linked according to the link criteria are input to the voice starting point & ending point determiner 110.

The voice starting point & ending point determiner 110 detects a starting and ending point of the linked micro events. The voice starting point & ending point determiner 110 can control accuracy of the detection of the starting and ending point of the linked micro events according to a characteristic of a voice signal. For example, the starting and ending points of the linked micro events are detected according to the characteristic of a voice signal very accurately (best) or as accurately as the detection result does not affect performance of voice signal detection (second best). The voice starting point & ending point determiner 110 determines a starting point and an ending point of a voice signal using the detected starting and ending points of the linked micro events and detects a voice signal portion from the input signal in which background noise and voice coexist using the determined starting and ending points of the voice signal.

The voice signal detection system according to the, present invention which has the above-described configuration, determines the peak count ratio r using peak distribution of the background noise in a state where only the background noise exists, determines the threshold voltage level L corresponding to the peak count ratio r, detects peaks having a voltage level greater than the determined threshold voltage level L from among peaks corresponding to a voice signal, which are included in the input signal in which background noise and voice coexist, and detects voice by detecting starting and ending points of the voice from the peaks corresponding to the voice signal.

Thus, since the voice signal detection system according to the current embodiment detects a voice signal using peak information of a time axis of an input signal, there is minimal calculation and effect of background noise, and an optimal voice signal detection method can be applied to various noise environments.

Figure 2:
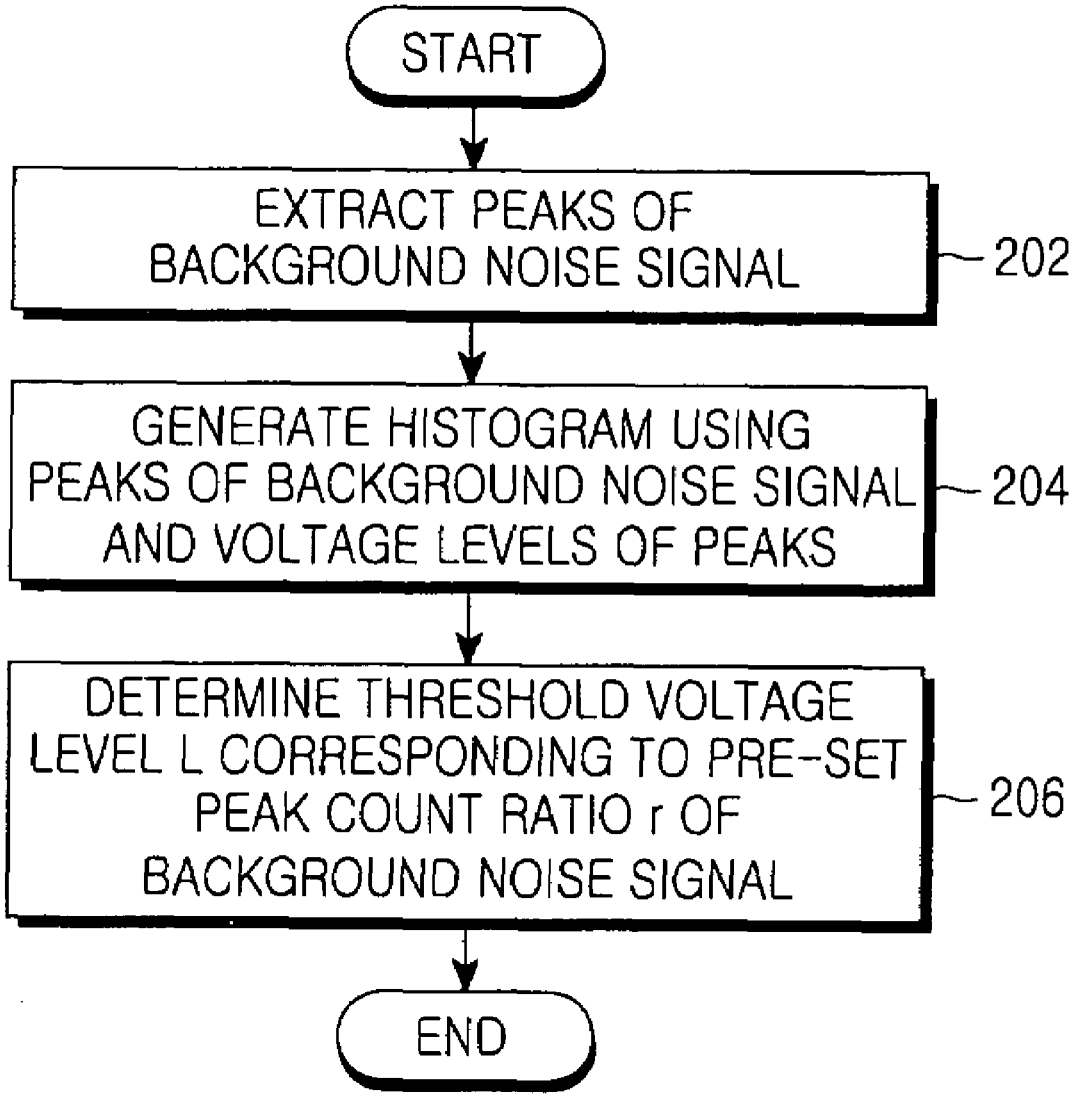
FIG. 2 is a flowchart illustrating a process of determining a threshold voltage level using peak distribution of background noise according to the present invention.

FIG. 2 is a flowchart illustrating the process of determining the threshold voltage level L using peak distribution of background noise according to the present invention.

Referring to FIG. 2, in step 202, the voice signal detection system receives an input signal in which only a background noise signal exists and extracts peaks of the background noise signal.

In step 204, the voice signal detection system generates a histogram using the peaks of the background noise signal and voltage levels of the peaks.

Figure 3A:
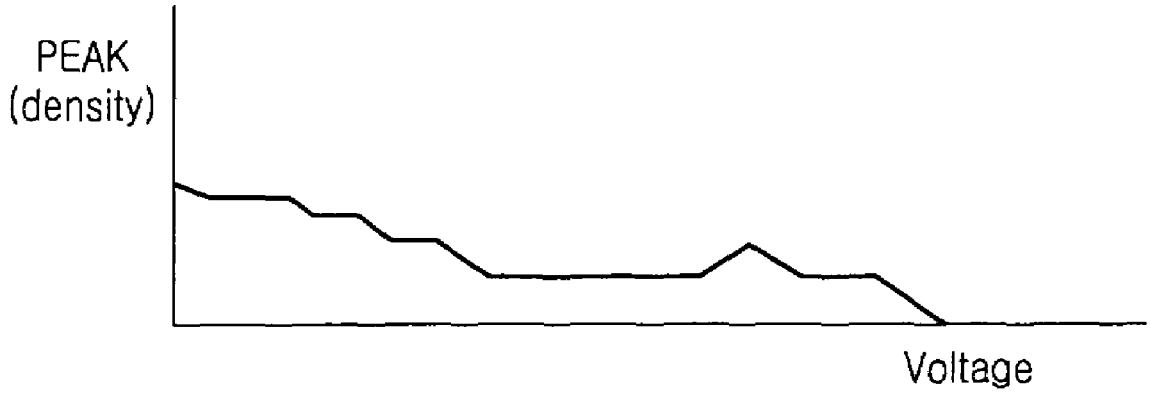
FIGS. 3A and 3B are histograms showing peaks of a background noise signal and voltage levels of the peaks according to the present invention.
Figure 3B:
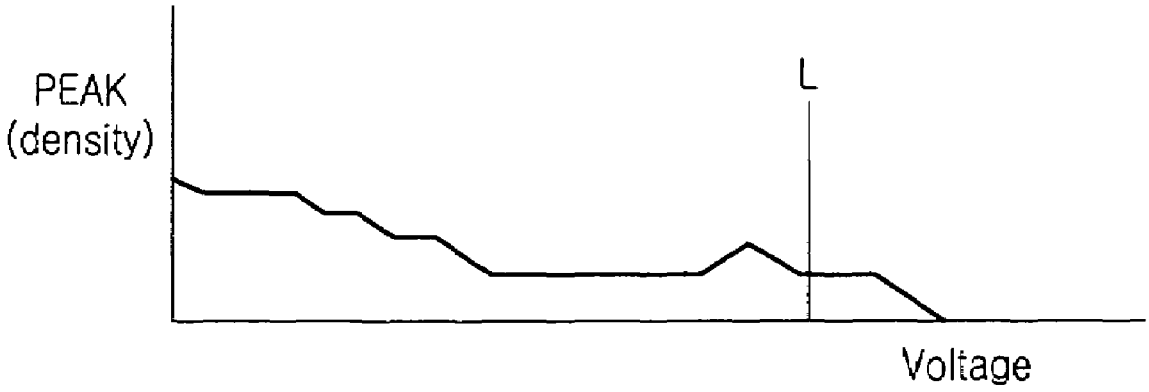

In step 206, the voice signal detection system determines the threshold voltage level L according to the pre-set peak count ratio r so that peaks corresponding to the peak count ratio r are greater than the threshold voltage level L in peak distribution of entire background noise as illustrated in FIG. 3B.

After determining the threshold voltage level L, the voice signal detection system detects voice by determining starting and ending points of a voice signal included in an input signal using the determined threshold voltage level L.

FIGS. 3A and 3B show the histogram of the peaks of the background noise signal and the voltage levels of the peaks. In FIG. 3, a horizontal axis indicates a voltage level, and a vertical axis indicates peak distribution. FIG. 3A shows peak distribution according to a voltage level.

Figure 4:
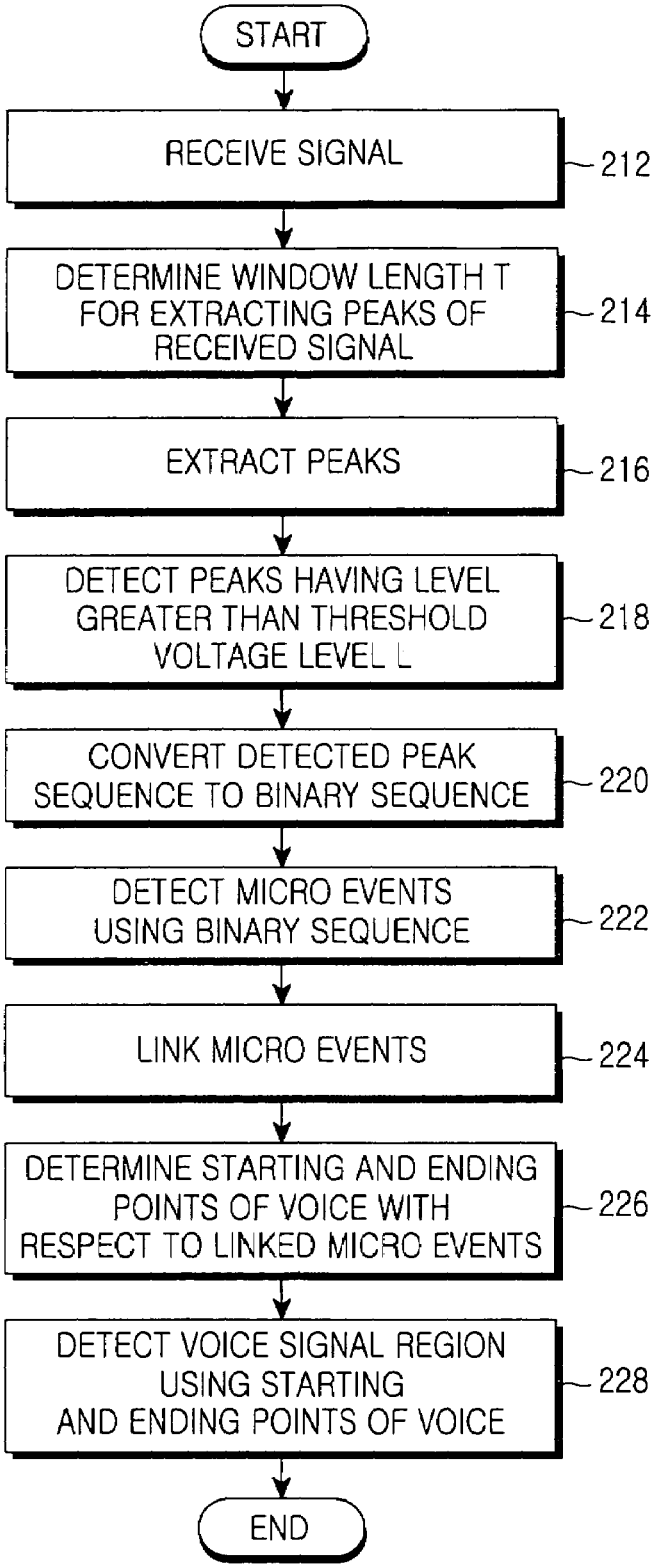
FIG. 4 is a flowchart illustrating a voice signal detection method using a threshold voltage level according to the present invention.

FIG. 4 is a flowchart illustrating a voice signal detection method using the threshold voltage level L according to the present invention. Referring to FIG. 4, in step 212, the voice signal detection system receives a signal. In step 214, the system determines the window length T for extracting peaks of the input signal.

In step 216, the system extracts peaks from the input signal based on the determined window length T. In step 218, the system detects peaks having a voltage level greater than the threshold voltage level L by comparing voltage levels of the extracted peaks to the threshold voltage level L.

In step 220, the voice signal detection system converts the detected peak sequence to a binary sequence according to whether voltage level of the detected peak sequence is greater than the threshold voltage level L. Herein, if a voltage level of the peak sequence extracted from the input signal is greater than the threshold voltage level L, the voltage level is converted to '1', and if a voltage level of the peak sequence extracted from the input signal is less than the threshold voltage level L, the voltage level is converted to '0'. For example, the peak sequence is converted to a binary sequence '1100011110001111'.

In step 222, the voice signal detection system detects micro events using the converted binary sequence. That is, the voice signal detection system determines the test window length W to examine the input binary sequence and obtains the number of peaks having the value '1' in each test window by examining the input binary sequence in a test window length unit. When the number of peaks having the value '1' out of total peaks in each test window reaches a pre-set number, the voice signal detection system detects this result as a micro event. The micro event can be a minimum unit of peaks that can be detected as voice.

After detecting the micro events, the voice signal detection system links the micro events in step 224. Herein, chains of the linked micro events correspond to parts of articulated voice. When the micro events are linked, if a gap exists between the linked micro events, a difference between the linked micro events and an original voice signal occurs, thereby creating uncertainty in detection of starting and ending points of the original voice signal. To solve this problem, link criteria for linking the micro events are set, and if the link criteria are satisfied, the link process is performed. In the current embodiment, if a gap between two micro events is preferably within 40 ms, the two micro events are linked (the two micro events can actually be linked in a range of 25-150 ms in reality).

After linking the micro events according to the link criteria, the voice signal detection system detects starting and ending points of the linked micro events in step 226. Herein, accuracy of the detection of the starting and ending points of the linked micro events can be controlled according to the characteristic of a voice signal. The voice signal detection system determines starting and ending points of a voice signal using the detected starting and ending points of the linked micro events.

In step 228, the voice signal detection system detects a voice signal portion from the input signal using the determined starting and ending points of the voice signal.

The voice signal detection system determines the peak count ratio r using peak distribution of background noise in a state where only the background noise exists, determines the threshold voltage level L corresponding to the peak count ratio r, detects peaks having a voltage level greater than the determined threshold voltage level L from among peaks corresponding to a voice signal, which are included in an input signal, and detects voice by detecting starting and ending points of the voice from the peaks corresponding to the voice signal.

Thus, since the voice signal detection system detects a voice signal using peak information of a time axis of an input signal, there is minimal calculation and effect of background noise, and an optimal voice signal detection method can be applied to various noise environments.

The voice signal detection method according to the current embodiment will now be described in more detail. Voice is detected based on the threshold voltage level L determined according to the pre-set peak count ratio r. A theory of an operating range of this non-parametric process can be developed by analyzing a white Gaussian signal in a Gaussian noise background using parameters. That is, according to the theory, plosives in the Gaussian noise background can be very accurately detected. An analytic example in which operational parameters can be selected using the theory will now be described.

In the voice signal detection method, two parameters having a close relationship, i.e., an amplitude threshold setting for determining an amplitude boundary between a background noise signal and an input signal and a peak-frequency (or rate-of-occurrence) threshold, must be selected.

Herein, decision of an amplitude consistency threshold is similar to a general detection threshold in sonar detection. This means that a conventional scheme can be used to specify a detection threshold of the present invention in a case of specific noise. According to a simple binary hypothesis constituted of a set of N statistically independent values, a noise-only signal and a signal-plus-noise signal can be presented using Equation 2.

$$H_0: r_i = n_i \text{ (for i=1, 2, . . . , N)},$$

$$H_1: r_i = S_i + n_i \text{ (for i=1, 2, . . . , N)} \tag{2}$$

In Equation 2, the signal-plus-noise signal and the noise-only signal can be presented using density functions of Equation 3 by a white Gaussian process.

$$P_{r_i|H_0}(X \mid H_0) = \frac{1}{\sqrt{2\pi\sigma_0}} \exp\left(-\frac{X^2}{2\sigma_0^2}\right) \tag{3}$$

$$P_{r_i|H_1}(X \mid H_1) = \frac{1}{\sqrt{2\pi\sigma_1}} \exp\left(-\frac{X^2}{2\sigma_1^2}\right)$$

In Equation 3, a mean value of the noise is not changed even though a signal is added. In this case, mean values of the signal and the noise are 0. However, if a Gaussian signal exists, the noise has a variance.

A scheme used most frequently to detect a variance of noise is a Bayer's criterion scheme for determining an optimum decision rule by minimizing total errors. An intermediate form according to the optimum Bayer's decision rule is presented using Equation 4.

$$\Lambda(R) \underset{H_0}{\overset{H_1}{\gtrless}} \eta \tag{4}$$

Equation 4 is a well-known likelihood ratio test form, where $\Lambda(R)$ denotes a likelihood ratio and $\eta$ denotes an amplitude threshold of the likelihood ratio test. Equation 4 is a basic form of a binary hypothesis test. By using the likelihood ratio test, a probability ratio of a set of observations r can be defined as Equation 5.

$$\Lambda(R) \equiv \frac{P_{r|H_1}(R \mid H_1)}{P_{r|H_0}(R \mid H_0)} \tag{5}$$

An experimental form of the likelihood ratio is obtained by substituting a PDF of noise and signal into an experience value and obtaining PDFs in which experience values are jointed. The amplitude threshold is suitable for the Bayer's criterion for minimizing decision costs and errors of prior probabilities.

In general, to set these items, some assumptions are previously required for the signal and the noise. A process of obtaining an equation available to an optimum decision scheme is performed by calculating a density function in which a set of N experience values is jointed. Since it is assumed that experience values are statistically independent, jointed density distributions can be used as a single sample density distribution.

$$P_{r|H_0}(R \mid H_0) = \prod_{i=1}^{N} \frac{1}{\sqrt{2\pi\sigma_0}} \exp\left(-\frac{R_i^2}{2\sigma_0^2}\right) \tag{6}$$

$$P_{r|H_1}(R \mid H_1) = \prod_{i=1}^{N} \frac{1}{\sqrt{2\pi\sigma_1}} \exp\left(-\frac{R_i^2}{2\sigma_1^2}\right) \tag{7}$$

If Equations 6 and 7 are substituted into Equation 5, Equation 4, which is the likelihood ratio test form, the result can be presented using Equation 8.

$$\prod_{i=1}^{N} \frac{1}{\sqrt{2\pi\sigma_1}} \exp\left(-\frac{R_i^2}{2\sigma_1^2}\right) \underset{H_0}{\overset{H_1}{\gtrless}} \eta \prod_{i=1}^{N} \frac{1}{\sqrt{2\pi\sigma_0}} \exp\left(-\frac{R_i^2}{2\sigma_0^2}\right) \tag{8}$$

In general, Equation 8 can be rearranged using a form containing sufficient statistic values, which allows a standard detection method to be determined.

To simplify a correlation with the voice signal detection method according to the present invention, it is required that Equation 8 remains in the intermediate form as shown above.

Herein, binary coefficients of noise to obtain a probability of false alarm are used in Equation 9.

$$P(FA) = \sum_{k=i}^{m} \binom{m}{k} p_n^k q_n^{m-k} \tag{9}$$

In Equation 9, $q_n$ denotes a probability of success (POS), and $p_n$ denotes a probability of failure (POF).

That is, if $q_n$ and $p_n$ in Equation 9 are 0.995 and 0.005, respectively, a probability that more than 8 peaks out of 10 peaks exceed a noise threshold is 1.74E-17. In this example, it is important that it is determined that only 0.5% of peaks exist above the noise threshold. To detect voice, by increasing the POS to be greater than the POF, i.e., increasing $q_n$ to be greater than 0.005, it is controlled for a signal for changing a potential distribution state to exist. This analysis provides a motivation for using the likelihood ratio test in comparison of sums of two different binary coefficients.

Thus, in the present invention, binary coefficients of noise are compared to binary coefficients of signal and noise. The comparison of the binary coefficients of noise and the binary coefficients of signal and noise is performed using Equation 10.

$$\sum_{k=i}^{n}\binom{m}{k}p_s^k q_s^{n-k} \underset{H_0}{\overset{H_1}{\gtrless}} \sum_{k=i}^{n}\binom{n}{k}p_n^k q_n^{n-k} \tag{10}$$

In Equation 10, the sums of two different binary coefficients based on areas of trailing portions of two different distributions (signal and noise) are compared to each other. In the likelihood ratio test, each of the sums of two different binary coefficients is a binary sum or a sufficient statistic value.

When the present invention is applied in practice, a look-up table can be used instead of the direct calculation using Equation 10 to determine threshold settings in noise-peak distributions.

The threshold settings are based on a peak histogram and are determined by peak amplitude settings in practice.

To use Equation 10, there is a correlation between $p_n$, which is a probability of peaks having a value greater than a threshold in the noise, and $q_n$, which is a probability of peaks having a value greater than the threshold in the signal. To do this, a form for mathematically associating the peak PDFs of the signal and noise of Equation 3 with the binary parameters of Equation 10 is required.

To derive a peak PDF, order statistics (OS) can be used as a convenient statistical platform. The OS is a mathematical statistics method used to describe an order of a data sample set. Herein, a peak is defined as a set of three points of which an intermediate value is greater than two points in both sides.

The definition of peak is referred to references such as 'H. J. Larson, "Introduction to Probability Theory and Statistical Inference", 3rd ed., NY: Wiley, 1982.' and 'R. J. Larsen and M. L. Marx, "An Introduction to Mathematical Statistics and its Applications" 2nd edition, Prentice-Hall Inc., Engelwood Cliffs N.J., 1986.', and detailed description is omitted herein.

Let X be a continuous random variable with probability distribution function $f_x(x)$. If a random sample of size n is drawn from $f_x(x)$, the marginal PDF for the $i^{th}$ OS is given by $$f_{x_i}(y) = \frac{n!}{(i-1)!(n-1)!}[F_x(y)]^{i-1}[1-F_x(y)]^{n-1}f_x(y) \tag{11}$$

for $1 \leqq i \leqq n$.

Consider drawing a sample size of three points from a noise background. The quantity of interest is the third OS. Setting n=3, i=3 in the theorem and simplifying gives $$f_{x_3}(y)=3[F_x(y)]^2 f_x(y) \tag{12}$$

Equation 12 is the analytical expression of the PDF for the first order peaks for continuous random variables (for frame lengths of 3) [3]. To solve for the PDF of the peaks we need to insert the expression for the background noise, which is the zero-mean Gaussian PDF shown in (2). This gives the following form for the third OS, $$f_{x_3}(y) = 3\left[\int_{-\infty}^{y}\frac{1}{\sqrt{2\pi}\sigma_0}\exp\left(-\frac{x^2}{2\sigma_0^2}\right)dx\right]^2\frac{1}{\sqrt{2\pi}\sigma_0}\exp\left(-\frac{y^2}{2\sigma_0^2}\right) \tag{13}$$

In Equation 13, an integral value using a quadrature technique or a transformation approach must be calculated. In the transformation approach, a current integral value must be transformed to another integral form in which the current integral value can be easily calculated using linkable program libraries.

To do this, $x=t\sigma_0\sqrt{2}$ can be transformed to Equation 14.

$$dx=(\sigma_0\sqrt{2})dt \tag{14}$$

To easily calculate Equation 12, the limit of the integral can be applied as in Equation 15.

$$f_{x_3}(y) = 3\left[\int_{-\infty}^{\frac{y}{\sqrt{2}\sigma_0}}\frac{2}{\sqrt{\pi}}\exp(-t^2)dt\right]^2\frac{1}{\sqrt{2\pi}\sigma_0}\exp\left(-\frac{y^2}{2\sigma_0^2}\right) \tag{15}$$

In addition, a cumulative distribution function of Equation 12 can be transformed to Equation 16 using an error function.

$$f_{x_3}(y) = 3\left[\frac{1}{2}+\frac{1}{2}\mathrm{erf}\left(\frac{y}{\sqrt{2}\sigma_0}\right)\right]^2\frac{1}{\sqrt{2\pi}\sigma_0}\exp\left(-\frac{y^2}{2\sigma_0^2}\right), \quad \text{for } 0 \le y \tag{16}$$

$$f_{x_3}(y) = 3\left[\frac{1}{2}\mathrm{erfc}\left(\frac{y}{\sqrt{2}\sigma_0}\right)\right]^2\frac{1}{\sqrt{2\pi}\sigma_0}\exp\left(-\frac{y^2}{2\sigma_0^2}\right), \quad \text{for } 0 > y$$

Figure 5A:
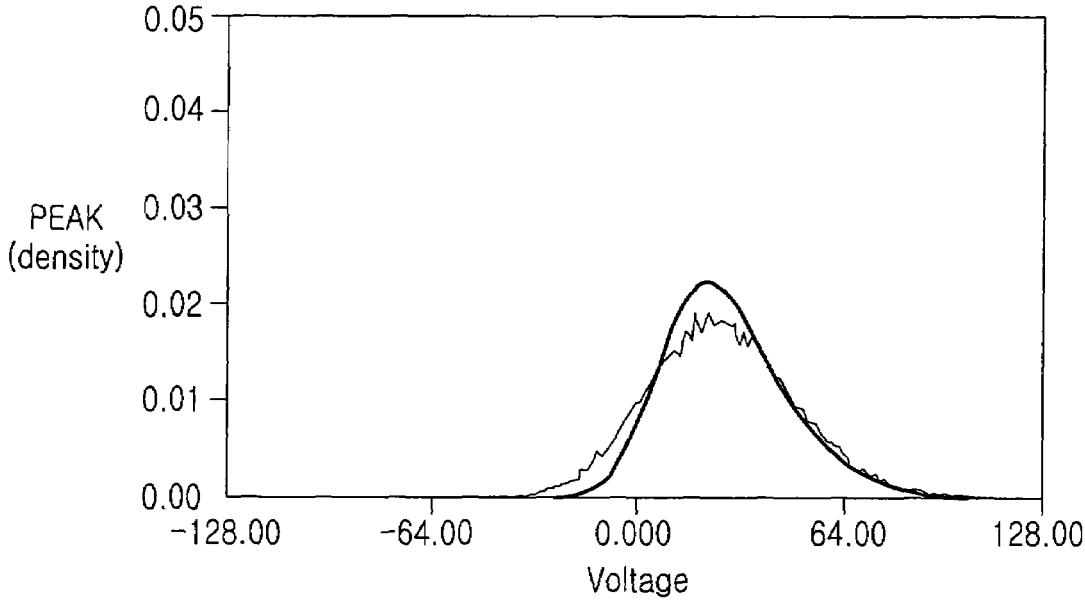
FIGS. 5A and 5B are graphs of probability density functions with respect to peaks of a background noise signal according to the present invention.
Figure 5B:
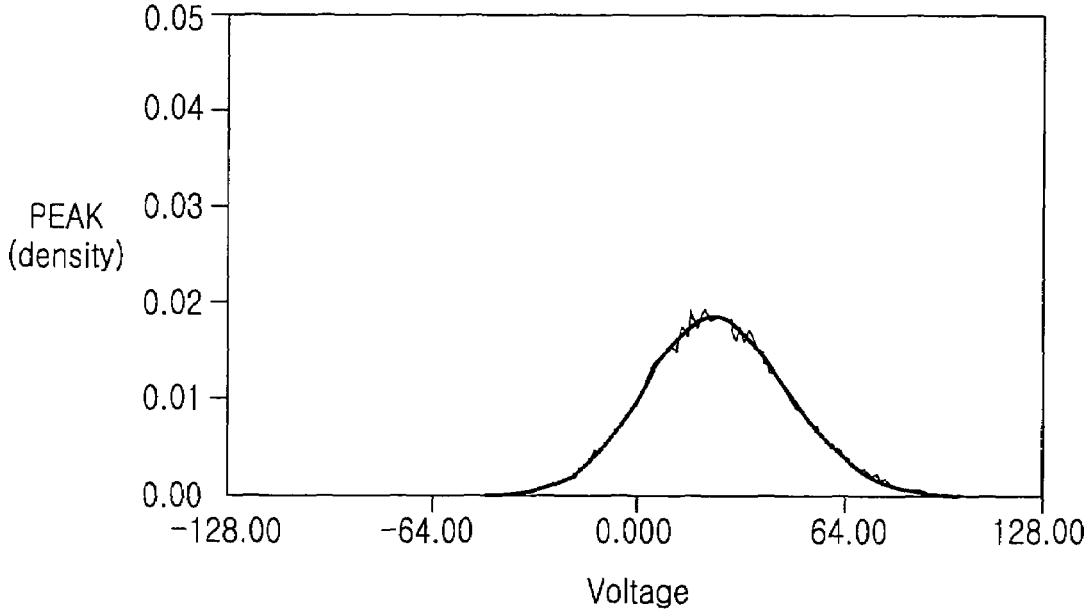

PDFs of Equation 16 are illustrated in FIGS. 5A and 5B. Referring to FIGS. 5A and 5B, FIG. 5A is a graph of a PDF using '3rd OS', and FIG. 5B is a graph of a PDF using modified '3rd OS'.

In each of FIGS. 5A and 5B, two probability density curves are shown. An irregular curve out of the two probability density curves is an experimental probability density curve for peaks of a Gaussian noise background having a mean of 0 and a standard deviation of 30 and is generated using a histogram technique for sequence peaks of Gaussian random numbers.

A regular curve is a probability density curve generated using Equation 16 and indicates a theoretical probability density curve for peak amplitudes according to the definition of '3rd OS'.

The irregular and regular curves must be well matched according to the definition of '3rd OS', however, it is not true because limitation to definition of '$i^{th}$ OS' exists in experimental analysis. Theoretically, '$i^{th}$ OS' involves the contents 'two certain values are not the same in an ordered set'. However, in the experimental analysis, 8-bit numbers limited to integers between −128 and +128 are used to store random numbers. Due to this limitation, a case where two of three points constituting a peak are the same may occur.

To solve this problem, Equation 17 indicating modified '3rd OS' is used in the present invention.

$$f_{x_3}(y)=3C[F_x(y)-f_x(y)]^2 f_x(y) \tag{17}$$

In Equation 17, C denotes a normalizing constant for Equation 17 to be an actual PDF. By recognizing that $f_x(y)$ occurs with a probability except 0, Equation 17 becomes modified '3rd OS'.

Thus, to maximize a set of three points constituting '3rd OS', $f_x(y)$ must be subtracted from a cumulative distribution function $F_x(y)$.

Equation 17 is calculated by multiplying three probabilities. For example, a case where three random numbers are selected from probability density having the same peak will now be described.

A first random number is selected with a probability of $f_x(y)$, and then, a probability with which a second random number smaller than the first random number is selected is $[F_x(y)-f_x(y)]$. A probability in which a third random number smaller than the first random number is selected is also $[F_x(y)-f_x(y)]$. Since the probabilities for selecting the three random numbers are independent, a probability with which the three random numbers are consecutive is calculated by multiplying the three probabilities.

There are six methods for satisfying '3$^{rd}$ OS' and selecting three random numbers. However, a real peak corresponds to a case where the highest point is located in the middle, and thus a probability in which the real peak exists is $\frac{2}{6}=\frac{1}{3}$. Thus, if an area below Equation 18 is about $\frac{1}{3}$, an appropriate selection for the normalizing constant is 3C.

$$[F_x(y)-f_x(y)]^2 f_x(y) \tag{18}$$

In FIGS. 5A and 5B, the same experimental peak PDF is used, and a Gaussian signal having a mean of 0 and a standard deviation of 30 is used as background noise. The regular curve illustrated in FIG. 5B indicates a theoretical peak PDF generated using Equation 17, i.e., modified '3$^{rd}$ OS' when C=1.029. Herein, the parameter C is calculated by normalizing Equation 17 and estimating an inverse function value so that Equation 17 becomes an appropriate PDF. Thus, in FIG. 5B, the theoretical PDF very accurately matches the experimental PDF.

That is, Equation 17 accurately matches an experimental histogram of a peak PDF. Based on this, Equation 17 can be used for noise-peak and single-peak Gaussian density functions.

This provides a 'missing link' necessary to describe an operation of the likelihood ratio test related to $p_n=1-q_n$ and $q_n=1-p_n$.

When the noise threshold is determined by determining the POS $p_n$, the POF $q_n$ of noise peaks is also determined.

Herein, the noise threshold has a 'rail' shape determined as a physical voltage level and can be described using percentages of the noise peaks below and above the rail. If a Gaussian signal exists, a new signal noise Gaussian density function is generated. This new curve has percentages of other peaks below and above the rail. Thus, if the POS $p_n$ of the noise peaks is defined, a potential POS $p_s$ of entire signal-plus-noise density is also defined.

Figure 6:
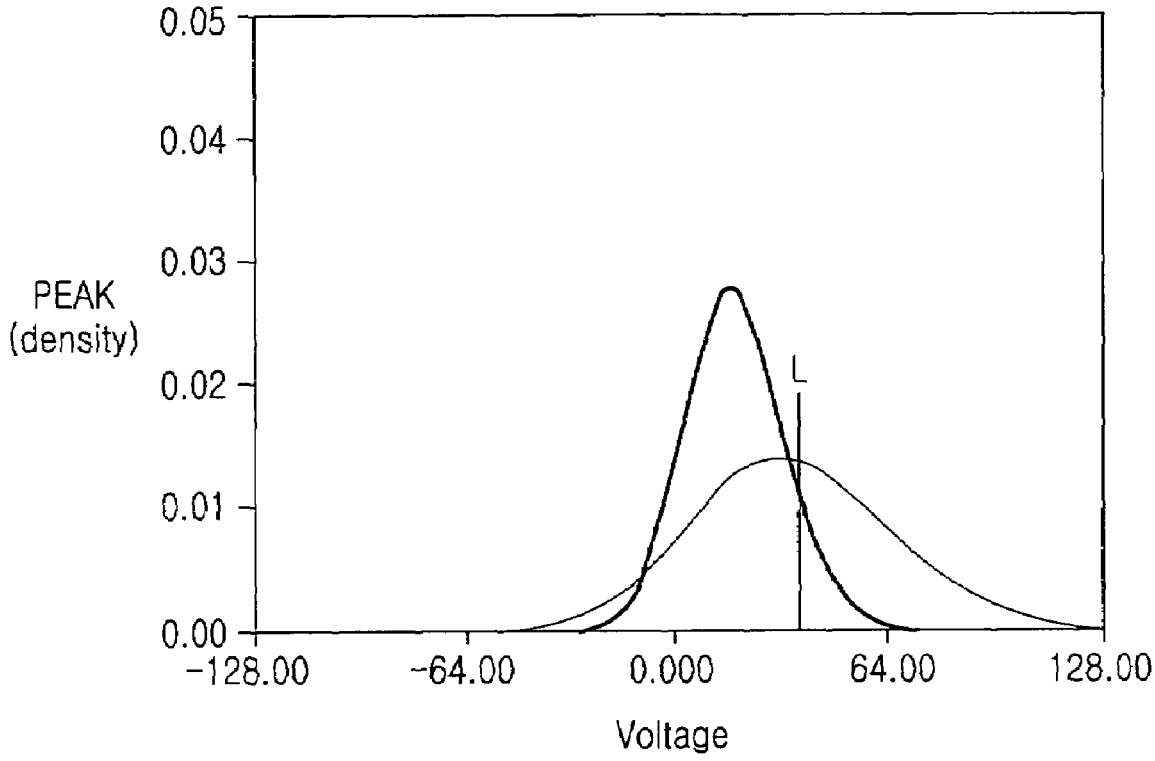
FIG. 6 is a graph of probability density functions with respect to a noise-only signal and a signal-plus-noise signal according to the present invention.

FIG. 6 is a graph of PDFs with respect to a noise-only signal and a signal-plus-noise signal according to the present invention. In FIG. 6, PDFs based on Equation 17, which is a form of modified '3$^{rd}$ OS', are shown. A curve having the higher peak in FIG. 6 is a PDF of noise peaks, and a curve having the lower peak is a PDF of signal-plus-noise peaks. In FIG. 6, the noise-only signal and the signal-plus-noise signal are zero mean Gaussian signals, and standard deviation is 20 in a case of the noise-only signal and 40 in a case of the signal-plus-noise signal. A consequent signal-to-noise ratio (SNR) is 4.8 dB and becomes a minimum acceptable target SNR for improved peak detection over other detection methods. A direct line of FIG. 6 indicates a threshold setting value with respect to a POS of high-level peaks among the noise peaks when $p_n=0.10$. Accordingly, a POF $q_n=0.9$, indicating that 90% of the noise peaks exist below the threshold setting value.

By presenting a threshold as a direct line, a percentage of peaks existing above the threshold of signal-plus-noise density is easily calculated using integration. In this case, the POF is set to 0.9 in the noise-only signal, and thus, the POF of the signal-plus-noise signal is 0.46.

$$\sum_{k=i}^{n}\binom{n}{k}p_s^k q_s^{n-k} \underset{H_0}{\overset{H_1}{\gtrless}} \sum_{k=i}^{n}\binom{n}{k}p_n^k q_n^{n-k} \tag{19}$$

As described above, since Equation 19 represents efficient statistics and defines a probability of detection and failure, Equation 19 can be used to generate a receiver operating characteristic (ROC) curve. In standard detector analysis of a Gaussian signal in Gaussian noise, since a coordinate system is a subset of the terms in the likelihood ratio test, the coordinate system must be changed to support the sufficient statistics.

Since the term in the right of Equation 19 indicates an area partitioned by the direct line and the curve of the PDF of noise peaks, the term in the right of Equation 19 becomes Equation 20, which is a probability of false alarm P(FA).

$$P(FA) = \sum_{k=i}^{n}\binom{n}{k}p_n^k q_n^{n-k} \tag{20}$$

In addition, $p_s$ is determined according to the level and type of signal that is detected after determining the noise threshold. Herein, a 'k out of n' parameter must be determined according to an attribute of the detected signal. Thus, performance of voice signal detection depends on proper settings of n and k.

The term in the left of Equation 19 indicates an area partitioned by the direct line and the curve of the PDF of signal-plus-noise peaks. The left term of Equation 19 can be presented using Equation 21.

$$P(D) = \sum_{k=i}^{n}\binom{n}{k}p_s^k q_s^{n-k} \tag{21}$$

When the POS and the POF are determined according to an amplitude of a signal relative to noise in Equation 21, n and k determine P(D), and a result of P(D) can be predicted. For example, if the signal-plus-noise peak PDF moves farther to the right, it indicates that a very large signal is input, and P(D)=1. However, since P(FA) depends on only a portion of the noise peak PDF, which is above the threshold, P(FA) is still not 0.

If the threshold is 0.9 in FIG. 6, i.e., if 90% of noise peaks exist below the threshold, consequent $p_s$ in a 6 dB Gaussian signal is 1.0−0.46=0.54. This information is used to generate an ROC curve in various settings of n and k. Each 'k out of n' scenario can be realized as an independent detector.

As an example of 'k out of n' scenarios, Table 1 indicates P(D) of various parameter settings of 'k out of 5' in three POF thresholds 0.9, 0.95, and 0.98 and P(FA) corresponding to P(D).

TABLE 1

| | $q_n = 0.9$, $q_s = 0.548$ | | $q_n = 0.95$, $q_s = 0.628$ | | $q_n = 0.98$, $q_s = 0.710$ | |
|---|---|---|---|---|---|---|
| n = 5 | P(D) | P(FA) | P(D) | P(FA) | P(D) | P(FA) |
| k = 1 | 0.95 | 0.409 | 0.90 | 0.226 | 0.82 | 0.096 |
| k = 2 | 0.75 | 0.081 | 0.61 | 0.023 | 0.45 | 3.8E−3 |
| k = 3 | 0.41 | 8.6E−3 | 0.27 | 1.2E−3 | 0.15 | 7.8E−5 |
| k = 4 | 0.13 | 4.6E−4 | 0.07 | 3.0E−5 | 0.03 | 7.9E−7 |
| k = 5 | 0.02 | 1.0E−5 | 0.01 | 3.1E−7 | 0.00 | 3.2E−9 |

Table 2 indicates P(D) of various parameter settings of 'k out of 10' in the three POF thresholds 0.90, 0.95, and 0.98 and P(FA) corresponding to P(D).

TABLE 2

| | $q_n = 0.9$, $q_s = 0.548$ | | $q_n = 0.95$, $q_s = 0.628$ | | $q_n = 0.98$, $q_s = 0.710$ | |
|---|---|---|---|---|---|---|
| n = 5 | P(D) | P(FA) | P(D) | P(D) | P(FA) | P(D) |
| k = 1 | 1.00 | 0.651 | 0.99 | 0.401 | 0.97 | 0.183 |
| k = 2 | 0.98 | 0.264 | 0.93 | 0.086 | 0.83 | 0.016 |
| k = 3 | 0.90 | 0.070 | 0.78 | 1.2E−2 | 0.59 | 8.6E−3 |
| k = 4 | 0.74 | 0.013 | 0.55 | 1.0E−3 | 0.32 | 3.1E−5 |
| k = 5 | 0.50 | 1.6E−3 | 0.30 | 6.0E−4 | 0.13 | 7.4E−7 |
| k = 6 | 0.27 | 1.5E−4 | 0.12 | 2.7E−6 | 0.04 | 1.3E−8 |
| k = 7 | 0.11 | 9.1E−6 | 0.04 | 8.1E−8 | 0.01 | 1.5E−10 |
| k = 8 | 0.03 | 3.7E−7 | 0.01 | 1.6E−9 | 0.00 | 1.1E−12 |
| k = 9 | 0.01 | 9.1E−9 | 0.00 | 1.8E−11 | 0.00 | 5.0E−15 |
| k = 10 | 0.00 | 1.0E−10 | 0.00 | 9.7E−14 | 0.00 | 1.0E−17 |

According to the present invention, using the above-described tables according to 'k out of n', a voice signal can be detected by setting n and k to proper values suitable for a situation.

Figure 7A:
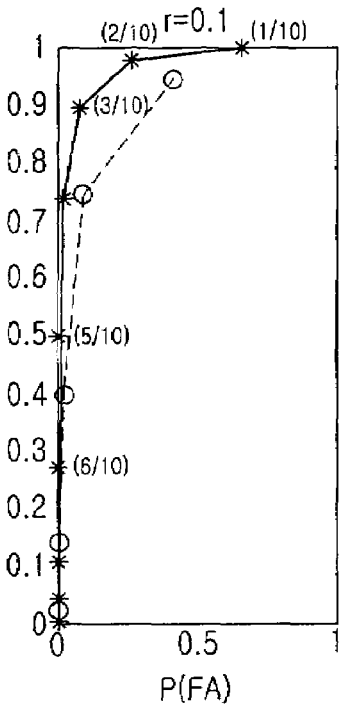
FIGS. 7A to 7C are graphs showing results obtained by detecting a voice signal using various settings according to the present invention.
Figure 7B:
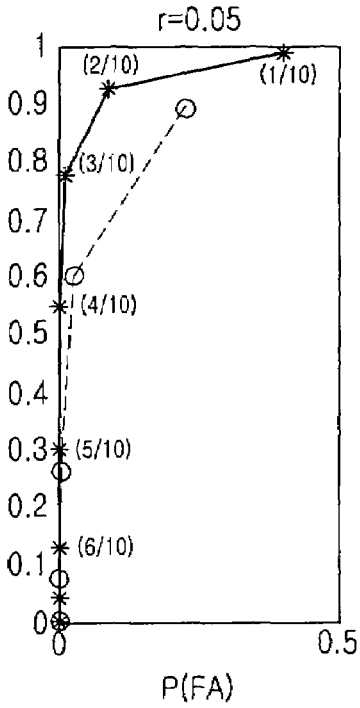
Figure 7C:
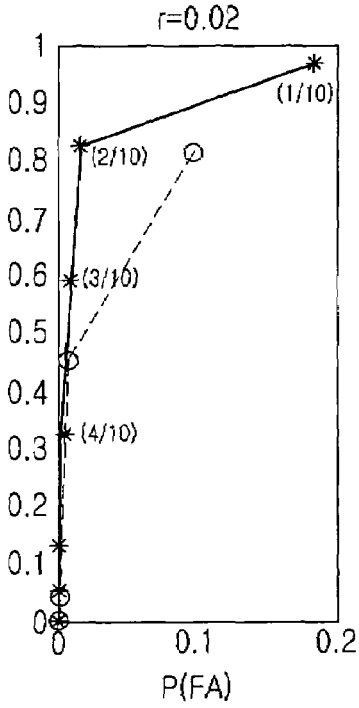

FIGS. 7A to 7C are graphs showing results obtained by detecting a voice signal using various settings of Tables 1 and 2 according to the present invention.

In FIGS. 7A to 7C, detection values are shown according to various settings when the peak count ration r=0.1, 0.05, and 0.02, wherein n=10 and 5, and k is changed from 1 to 10 and from 1 to 5.

Referring to FIG. 7, since an ending point of voice is detected from a peak (three data points), a maximum false alarm (FA) ratio must be set to control which detection is linked. Each peak detection is a single micro event based on the test window length W. Consecutive or adjacent micro events are naturally linked to each other, and non-adjacent micro events can also be linked to each other. In this case, micro events, which can generate a voice error, must not be linked to each other.

An available FA range is obtained using an experimental result that voice energy pulses separated by more than 150 ms almost always belong to different articulations. Thus, if FAs are separated by more than 150 ms, incorrect linking does not occur. Herein, 150 ms corresponds to 1200 points in 8 KHz and around 400 peaks in white noise. A single FA in every 150 ms corresponds to 6.67 FAs/sec, and with these settings, the voice signal detection method herein can correctly perform ending point detection. To compare this FA limitation to settings of a table, tabled P(FA) values must be converted from FAs with respect to a test window to FAs with respect to time. Information of these conversion FA rates is shown in Table 3.

TABLE 3

| | n = 5 | | |
|---|---|---|---|
| | 0.90 (r = 0.1) | 0.95 (r = 0.05) | 0.98 (r = 0.02) |
| k = 1 | 218 | 121 | 51 |
| k = 2 | 43 | 12 | 2* |
| k = 3 | 5* | 0.6* | 0.04* |
| k = 4 | 0.3* | 0.02* | 0.004* |
| k = 5 | 0.005* | N/A | 0.00002* |

Table 3 has conversion FA rate information of Table 1. Portions having a '*' mark show operation points satisfying the present invention according to FA settings in an 8 KHz sampling rate (when it is assumed that FAs exist one or less in every 150 ms).

A peak sequence is converted to a binary sequence based on the threshold voltage level L. If a test window is selected, the number of '1s' in the test window is checked to determine whether a signal exists, and if the threshold setting L divides top 20% from peaks, a probability that at least 8 out of 10 peaks exceed the threshold in a current noise background is 7.79E-05. This very low probability indicates that a test window containing 8 out of 10 peaks corresponds to a new signal, and not to background noise.

Herein, the numerical probability can be considered as P(FA) in a point of view of a 10-peak window. Since a test window (e.g., 5 in '4 out of 5') is constituted of $1^{st}$ order peaks existing at a ratio of one peak per three data points, an FA rate is 7.79E-05 per 30 data points.

Errors include additive errors by which a noise signal is recognized as a voice signal and subtractive errors by which a voice signal is recognized as a noise signal, and it is important that the subtractive errors by which information is lost are not generated. Thus, in a state of a low SNR, a threshold is much higher. In a case of a long test window, when a frequency of a sinusoidal wave is higher, peak clusters for detection are fewer. Thus, by using a shorter test window instead of a longer test window, the FA rate can be reduced, and a reliability of detecting peak clusters can be higher. For example, by reducing the length of a test window, the FA rate can improve to 3.0E-05 in '4 out of 5'. A normalized FA rate of this '4 out of 5' test window is 0.12 per second. Thus, for the number of peaks exceeding a threshold, if the length of a test window is minimized, P(FA) is minimized.

A basic concept is that the test window length W matches a peak cluster or a micro event to be detected. This information is used to reliably detect a sinusoidal wave having a low SNR for a short time. If the sinusoidal wave has a long wavelength, a processing gain is realized before detection, and thus, a spectral technique can be used. However, if the sinusoidal wave has a short wavelength, detection must be performed in a time axis. If the test window length W is reduced to 5, an area in which no detection is performed between peaks of a sinusoidal wave having a low frequency may exist. This becomes a problem only if each test window is required to contain a perfectly detected signal. If a signal is maintained over several test windows, first and last test windows can be used to define starting and ending points of the signal. In references, articulations are correlated to each other, and parameters are selected to determine whether the parameters can be used as linking criteria to detect voice. Herein, voice is generated by a relatively mechanical process, and an articulator part operates relatively slowly. For example, a ramp-up time of phonetic utterance is an order of 40 ms, indicating 480 data points in 12 KHz sampling.

During 480 data points, around 160 peaks are generated from white Gaussian data, and time allowed between correlated voice signals having low energy is around 150 ms. Thus, if no voice exists for 30 ms between a test window of '4 out of 5' and a subsequent test window of '4 out of 5', these two windows can be linked as a single event. In the present invention, this approach is used.

A peak sequence satisfying a small test window, such as '3 out of 4' or '4 out of 5', is called a micro event in the present invention. The micro event is a package containing the smallest number of peaks that can be detected in practice. To make this test window having a short length robust in a point of view of FA, a percentage of peaks having a level greater than a histogram threshold (i.e., peak count ratio r) can be set smaller. If these micro events are detected, a theory to determine whether the detected micro events are correlated to each other in a time axis can be used. If the micro events satisfy the temporal relationship threshold, the micro events can be linked. A chain of the linked micro events allows a part of articulated voice to be effectively detected. Herein, since the detection is performed in a set of micro events, several voice starting and ending points may be detected according to link criteria. Thus, flexible and optimal voice detection can be performed by applying characteristic extraction parameters suitable for a situation.

Results of experiments to compare performance are illustrated in Tables 4 and 5.

TABLE 4

| | A | B | C | D | A' | B' | C' | D' |
|---|---|---|---|---|---|---|---|---|
| 1 | 13900 | 17500 | 28635 | 32400 | 13900 | 17500 | 28635 | 32400 |
| 2 | 13966 | 17748 | 28773 | 32611 | 10002 | N/A(−) | N/A(−) | 37427 |
| | (+96) | (+248) | (+138) | (+211) | (−3898) | | | (+5027) |
| 3 | 14657 | 17755 | 28929 | 32772 | 14890 | 14008 | 29896 | 30125 |
| | (+757) | (+255) | (+294) | (+372) | (+990) | (−3492) | (+1261) | (−2275) |
| 4 | 13996 | 17735 | 28773 | 32772 | 10002 | N/A(−) | N/A(−) | 37427 |
| | (+96) | (+235) | (+138) | (+372) | (−3898) | | | (+5027) |
| 5 | 13897 | 17529 | 28633 | 32412 | 13874 | 17652 | 28574 | 32535 |
| | (−3) | (+29) | (−2) | (+12) | (−26) | (+152) | (−61) | (+135) |

TABLE 5

| | A | B | C | D | A' | B' | C' | D' |
|---|---|---|---|---|---|---|---|---|
| 1 | 8570 | 16000 | 24575 | 32300 | 8570 | 16000 | 24575 | 32300 |
| 2 | 8651 | 16101 | 24648 | 33173 | 4609 | N/A(−) | N/A(−) | 37304 |
| | (+81) | (+101) | (+73) | (+873) | (−3961) | | | (+5004) |
| 3 | 8702 | 16206 | 24735 | 33145 | 9529 | 13476 | 25801 | 30590 |
| | (+132) | (+206) | (+160) | (+845) | (+959) | (−2524) | (+1226) | (−1710) |
| 4 | 8651 | 16101 | 24648 | 33173 | 4609 | N/A(−) | N/A(−) | 37304 |
| | (+81) | (+101) | (+73) | (+873) | (−3961) | | | (+5004) |
| 5 | 8567 | 16017 | 24551 | 32251 | 8545 | 16067 | 24501 | 32436 |
| | (−3) | (+17) | (−24) | (−49) | (−25) | (+67) | (−74) | (+136) |

Referring to Tables 4 and 5, No. 1 indicates an ideal case, and figures in parentheses refer to the amount of errors. No. 2 indicates a voice detection result obtained by using an energy detection method. No. 3 indicates a voice detection result obtained by using a zero crossing method. No. 4 indicates a voice detection result obtained by using both the energy detection method and the zero crossing method. No. 5 indicates a voice detection result obtained by using the voice signal detection method according to the present invention.

In Table 4, 'eight' is articulated twice, and A (A') denotes a starting point of first articulation, B (B') denotes an ending point of the first articulation, C (C') denotes a starting point of second articulation, and D (D') denotes an ending point of the second articulation, wherein A, B, C, and D are obtained when very little noise exists (30 dB), and A', B', C', and D' are obtained when strong noise exists (5 dB). Unlike conventional methods, in the voice detection result according to the present invention, the subtractive error by which information is lost is not generated. In Table 5, 'nine' is articulated twice, and the subtractive error is not generated as in Table 4. That is, as compared to the conventional methods, the voice signal detection method according to the present invention has a significantly improved performance in a noise environment, no subtractive error is generated, and complexity of calculation is very low.

As described above, by suggesting a voice signal detection method using extraction and analysis of peak characteristic information of a time axis, voice can be detected with a little calculation by performing a simple sample size comparison, and the voice detection is very robust over noise by allowing the voice to always exist above a noise level.

In addition, unlike conventional frame-based detection, sample-based voice detection is performed, and thus, much more accurate detection within a few samples can be achieved.

According to a state of noise, a characteristic extraction variable (peak count ratio) can be optimized, and flexibility is increased by providing best and second best voice detection starting and ending points.

By using a characteristic of peak information, a subtractive error by which voice information may be lost can be prevented.

The voice signal detection method can be used without additional parameter definition, and unlike conventional voice signal detection methods, no assumption for a signal is required.

Since flexible voice detection can be performed by selecting an optimal detection method suitable for a state, the voice signal detection method can be used in a front end of voice coding, recognition, strengthening and synthesis.

Moreover, since voice can be accurately detected with a small amount of calculation, the voice signal detection method is effective to applications such as mobile terminals, telematics, personal digital assistances (PDAs), and MP3, all of which have high mobility, limited storage capacity and a requisite quick processing.

While the invention has been shown and described with reference to preferred embodiments thereof, it will be understood by those skilled in the art that various changes in form and details may be made therein without departing from the spirit and scope of the invention as defined by the appended claims.

What is claimed is:

1. A voice signal detection system, comprising:

a peak extractor for extracting peaks from an input signal;

a peak detector for comparing a voltage level of each of the extracted peaks to a threshold voltage level and converting the comparison result to a binary sequence;

a micro event detector for determining a length of a test window to examine the converted binary sequence and detecting micro events in a test window length unit;

a micro event link module for linking the detected micro events; and a voice signal starting point and ending point detector for determining a starting point and an ending point of a voice signal by detecting a starting point and an ending point of the linked micro events.

2. The voice signal detection system of claim 1, wherein the micro event is a minimum unit of peaks that are detected as voice.

3. The voice signal detection system of claim 1, further comprising a threshold voltage level determiner for determining the threshold voltage level corresponding to a peak count ratio using a histogram of voltage levels of peaks extracted from a background noise signal.

4. The voice signal detection system of claim 1, further comprising a background noise histogram generator for generating a histogram using the peaks extracted from the background noise signal and the voltage levels of the extracted peaks.

5. The voice signal detection system of claim 1, wherein the micro event detector obtains a sequence of a number of peaks having a level greater than the threshold voltage level in each test window and detects the sequence as a micro event if the number of peaks having a level greater than the threshold voltage level in each test window reaches a pre-set number.

6. The voice signal detection system of claim 1, wherein the micro event link module links micro events, which satisfy a temporal relationship threshold to each other, among the detected micro events.

7. The voice signal detection system of claim 6, wherein the temporal relationship threshold is 40 ms.

8. The voice signal detection system of claim 1, wherein the voice signal starting point and ending point detector changes accuracy of the detection of the starting point and the ending point of the linked micro events according to a characteristic of the voice signal.

9. A voice signal detection method, comprising the steps of:

extracting peaks from an input signal;

comparing a voltage level of each of the extracted peaks to a threshold voltage level and converting the comparison result to a binary sequence;

determining a length of a test window to examine the converted binary sequence and detecting micro events in a test window length unit;

linking the detected micro events; and determining a starting point and an ending point of a voice signal by detecting a starting point and an ending point of the linked micro events.

10. The voice signal detection method of claim 9, wherein the micro event is a minimum unit of peaks that are detected as voice.

11. The voice signal detection method of claim 9, further comprising determining the threshold voltage level corresponding to a peak count ratio using a histogram of voltage levels of peaks extracted from a background noise signal.

12. The voice signal detection method of claim 11, further comprising generating the histogram using the peaks extracted from the background noise signal and the voltage levels of the extracted peaks.

13. The voice signal detection method of claim 9, further comprising obtaining a sequence of a number of peaks having a level greater than the threshold voltage level in each test window; and detecting the sequence as a micro event if the number of peaks having a level greater than the threshold voltage level in each test window reaches a pre-set number.

14. The voice signal detection method of claim 9, wherein the step of linking the detected micro events further comprises:

determining whether the detected micro events satisfy a temporal relationship threshold to each other; and if the detected micro events satisfy the temporal relationship threshold to each other, linking the detected micro events.

15. The voice signal detection method of claim 14, wherein the temporal relationship threshold is 40 ms.

16. The voice signal detection method of claim 9, further comprising changing accuracy of the detection of the starting point and the ending point of the linked micro events according to a characteristic of the voice signal.

* * * * *